US005997806A

United States Patent [19]

Fujita et al.

[11] Patent Number: 5,997,806

[45] Date of Patent: Dec. 7, 1999

[54] HEAT-RESISTING CAST STEEL

[75] Inventors: Akitsugu Fujita; Masatomo Kamada, both of Nagasaki, Japan

[73] Assignee: Mitsubishi Heavy Industries, Ltd., Tokyo, Japan

[21] Appl. No.: 09/103,371

[22] Filed: Jun. 24, 1998

[30] Foreign Application Priority Data

Jul. 16, 1997 [JP] Japan ..... 9-190925

[51] Int. Cl.[6] ..... C22C 38/44; C22C 38/52

[52] U.S. Cl. ..... 420/38; 420/37

[58] Field of Search ..... 420/38, 37

[56] References Cited

U.S. PATENT DOCUMENTS

| | | | |
|---|---|---|---|
| 5,560,788 | 10/1996 | Yamada et al. | 148/326 |
| 5,591,391 | 1/1997 | Igarashi et al. | 420/38 |

FOREIGN PATENT DOCUMENTS

| | | |
|---|---|---|
| 691416A1 | 1/1996 | European Pat. Off. . |
| 59-216322 | 10/1984 | Japan . |
| 3053047 | 3/1991 | Japan . |
| 4371551 | 12/1992 | Japan . |
| 7197208 | 8/1995 | Japan . |
| 7286246 | 10/1995 | Japan . |
| 8333657 | 12/1996 | Japan . |

OTHER PUBLICATIONS

JP Abstract: Morinaga, et al., "Process for Prosucing Ferritic Iron–Base Alloy and Ferritic Heat Resistant Steel", WO 9601334 Jan. 1996.

JP Abstract; Makoto, et al., "High–Chromium Cast Steel for High Temperature Service Pressure Vessel", May 14, 1986.

*Primary Examiner*—Deborah Yee

*Attorney, Agent, or Firm*—Birch, Stewart, Kolasch & Birch, LLP

[57] ABSTRACT

This invention provides a heat-resisting cast steel which is a high-Cr steel material having excellent high-temperature strength and hence suitable for use as a high-temperature steam turbine casing material capable of being used even at a steam temperature of 600° C. or above. This heat-resisting cast steel contains, on a weight percentage basis, 0.07 to 0.15% carbon, 0.05 to 0.30% silicon, 0.1 to 1% manganese, 8 to 10% chromium, 0.01 to 0.2% nickel, 0.1 to 0.3% vanadium, a total of 0.01 to 0.2% niobium and tantalum, 0.1 to 0.7% molybdenum, 1 to 2.5% tungsten, 0.1 to 5% cobalt and 0.03 to 0.07% nitrogen, the balance being iron and incidental impurities.

11 Claims, No Drawings

HEAT-RESISTING CAST STEEL

BACKGROUND OF THE INVENTION

1. Field of the Invention

This invention relates to heat-resisting cast steels which can be used as structural materials for the manufacture of pressure vessels such as the casings of steam turbines for thermal electric power generation.

2. Description of the Related Art

Conventionally, used high-temperature casing materials used in steam turbine plants for thermal electric power generation include 2.25% CrMo cast steel, CrMo cast steel, CrMoV cast steel and 12 Cr cast steel. Among these cast steels, the use of cast steels comprising low-alloy steels such as 2.25% CrMo cast steel, CrMo cast steel and CrMoV cast steel is restricted to plants having a maximum steam temperature of 566° C. because of their limited high-temperature strength. On the other hand, 12 Cr cast steel (e.g., those disclosed in Japanese Patent Application No. 59-216322 and the like) have superior high-temperature strength to cast steels comprising low-alloy steels, and hence can be used in plants having a steam temperature up to approximately 600° C. However, if the steam temperature exceeds 600° C., 12 Cr cast steel has insufficient high-temperature strength and as such, are rarely used for pressure vessels such as steam turbine casings.

SUMMARY OF THE INVENTION

An object of the present invention is to provide heat-resisting cast steels which are high-Cr steel materials having excellent high-temperature strength and are suitable for use as high-temperature steam turbine casing materials wherein the steam temperature reaches 600° C. or higher.

To this end, the present inventors made intensive investigations and have now found the following excellent heat-resisting cast steels.

That is, a first heat-resisting cast steel in accordance with the present invention contains, on a weight percentage basis, 0.07 to 0.15% carbon, 0.05 to 0.30% silicon, 0.1 to 1% manganese, 8 to 10% chromium, 0.01 to 0.2% nickel, 0.1 to 0.3% vanadium, a total of 0.01 to 0.2% niobium and tantalum, 0.1 to 0.7% molybdenum, 1 to 2.5% tungsten, 0.1 to 5% cobalt and 0.03 to 0.07% nitrogen, the balance being iron and incidental impurities.

A second heat-resisting cast steel in accordance with the present invention contains, on a weight percentage basis, 0.07 to 0.15% carbon, 0.05 to 0.30% silicon, 0.01 to 0.1% manganese, 8 to 10% chromium, 0.01 to 0.2% nickel, 0.1 to 0.3% vanadium, a total of 0.01 to 0.2% niobium and tantalum, 0.01 to 0.07% nitrogen, 0.1 to 0.7% molybdenum, 1 to 2.5% tungsten and 0.1 to 5% cobalt, the balance being iron and incidental impurities.

A third heat-resisting cast steel in accordance with the present invention contains, on a weight percentage basis, 0.07 to 0.15% carbon, 0.05 to 0.30% silicon, 0.1 to 1% manganese, 8 to 10% chromium, 0.01 to 0.2% nickel, 0.1 to 0.3% vanadium, a total of 0.01 to 0.2% niobium and tantalum, 0.1 to 0.7% molybdenum, 1 to 2.5% tungsten, 0.1 to 5% cobalt, 0.001 to 0.03% nitrogen and 0.002 to 0.01% boron, the balance being iron and incidental impurities.

A fourth heat-resisting cast steel in accordance with the present invention contains, on a weight percentage basis, 0.07 to 0.15% carbon, 0.05 to 0.30% silicon, 0.01 to 0.1% manganese, 8 to 10% chromium, 0.01 to 0.2% nickel, 0.1 to 0.3% vanadium, a total of 0.01 to 0.2% niobium and tantalum, 0.1 to 0.7% molybdenum, 1 to 2.5% tungsten, 0.1 to 5% cobalt, 0.001 to 0.03% nitrogen and 0.002 to 0.010% boron, the balance being iron and incidental impurities.

A fifth heat-resisting cast steel in accordance with the present invention is any of the above-described first to fourth heat-resisting cast steels which contain, on a weight percentage basis, 0.001 to 0.2% neodymium and 0.01 to 1% nickel.

A sixth heat-resisting cast steel in accordance with the present invention is any of the above-described first to fourth heat-resisting cast steels which contain, on a weight percentage basis, 0.001 to 0.2% hafnium and 0.01 to 1% nickel.

A seventh heat-resisting cast steel in accordance with the present invention is the above-described sixth heat-resisting cast steel which contains, on a weight percentage basis, 0.001 to 0.2% neodymium.

An eighth heat-resisting cast steel in accordance with the present invention is any of the above-described first to seventh heat-resisting cast steels wherein the index A (%) defined by the following equation on a weight percentage basis is 8% or less.

$$\text{Index A (\%)} = (\text{Cr content})(\%) + 6(\text{Si content})(\%) + 4(\text{Mo content})(\%) + 3(\text{W content})(\%) + 11(\text{V content})(\%) + 5(\text{Nb content})(\%) - 40(\text{C content})(\%) - 2(\text{Mn content})(\%) - 4(\text{Ni content})(\%) - 2(\text{Co content})(\%) - 30(\text{N content})(\%)$$

As described above, the first heat-resisting cast steel of the present invention has excellent high-temperature strength and is hence useful as a high-temperature steam turbine casing material for use in hypercritical-pressure electric power plants having a steam temperature higher than 600° C. Thus, the first heat-resisting cast steel of the present invention enables an increase in the operating temperature over the current hypercritical-pressure electric power plants (having a steam temperature of about 600° C.) which afford a saving of fossil fuels and, moreover, reduce the amount of carbon dioxide evolved and thereby contribute to the improvement of the global environment.

The effects of the second heat-resisting cast steel are basically the same as those of the first heat-resisting cast steel. However, since its high-temperature strength is further improved by reducing the content of Mn, the second heat-resisting cast steel makes it possible to operate hypercritical-pressure electric power plants under higher temperature conditions than when the first heat-resisting cast steel is used, resulting in a decreased need for fossil fuels, and consequently reducing the amount of carbon dioxide evolved.

The third heat-resisting cast steel is characterized by the addition of B to the first heat-resisting cast steel, so that its high-temperature strength is slightly improved over the first heat-resisting cast steel. Consequently, the third heat-resisting cast steel makes it possible to operate hypercritical-pressure electric power plants with higher reliability.

The effects of the fourth heat-resisting cast steel are basically the same as those of the first heat-resisting cast steel. However, since its high-temperature strength is further improved by reducing the content of Mn and adding B, the fourth heat-resisting cast steel makes it possible to operate hypercritical-pressure electric power plants under higher temperature conditions than when the first heat-resisting cast steel is used, resulting in a decreased need for fossil fuels, and consequently reducing the amount of carbon dioxide evolved.

The effects of the fifth heat-resisting cast steel are basically the same as those of the first to fourth heat-resisting cast steels. However, since its high-temperature strength is further improved by the addition of Mn, the fifth heat-resisting cast steel makes it possible to operate hypercritical-pressure electric power plants under higher temperature conditions than when the first to fourth heat-resisting cast steels are used, resulting in a decreased need for fossil fuels, and consequently reducing the amount of carbon dioxide evolved.

The effects of the sixth heat-resisting cast steel are basically the same as those of the first to fourth heat-resisting cast steels. However, since its high-temperature strength is further improved by the addition of Hf, the sixth heat-resisting cast steel makes it possible to operate hypercritical-pressure electric power plants under higher temperature conditions than when the first to fourth heat-resisting cast steels are used, resulting in a decreased need for fossil fuels, and consequently reducing the amount of carbon dioxide evolved.

The effects of the seventh heat-resisting cast steel are basically the same as those of the first to fourth heat-resisting cast steels. However, since its high-temperature strength is further improved by the combined addition of Nd and Hf, the seventh heat-resisting cast steel makes it possible to operate hypercritical-pressure electric power plants under higher temperature conditions than when the first to fourth heat-resisting cast steels are used, resulting in a decreased need for fossil fuels, and consequently reducing the amount of carbon dioxide evolved.

The effects of the eighth heat-resisting cast steel are basically the same as those of the first to seventh heat-resisting cast steels. However, this provides a material in which the formation of δ-ferrite (a structure causing a reduction in high-temperature strength and also a reduction in ductility and toughness) is prevented by imposing restrictions on the contents of alloying elements. Thus, the eighth heat-resisting cast steel makes it possible to operate hypercritical-pressure electric power plants at higher temperatures, resulting in a decreased need for fossil fuels, and consequently reducing the amount of carbon dioxide evolved.

DETAILED DESCRIPTION OF THE PREFERRED EMBODIMENTS

The present inventors made intensive investigations in order to improve high-temperature strength by using a high-Cr steel as a basic material and controlling the contents of alloying elements strictly, and have now discovered new heat-resisting cast steels having excellent high-temperature strength characteristics which have not been observed in conventional materials.

First Heat-Resisting Cast Steel of the Present Invention

The reasons for content restrictions in the first heat-resisting cast steel of the present invention are described below. In the following description, all percentages used to represent contents are by weight unless otherwise stated.

C (carbon): C, together with N, forms carbonitrides and thereby contributes to the improvement of creep rupture strength. Moreover, C acts as an austenite-forming element to inhibit the formation of δ-ferrite. If its content is less than 0.07% by weight, no sufficient effect will be produced, while if its content is greater than 0.15% by weight, the carbonitrides will aggregate during use to form coarse grains, resulting in a reduction in long-time high-temperature strength. In addition, high C contents will bring about poor weldability and may hence cause difficulties such as weld crack during the manufacture of pressure vessels and the like. For these reasons, C must not be added in an amount greater than that required to improve high-temperature strength by the formation of carbonitrides and to inhibit the formation of δ-ferrite. Accordingly, the content of C should be in the range of 0.07 to 0.15%. The preferred range is from 0.08 to 0.14%.

Si (silicon): Si is effective as a deoxidizer. Moreover, Si is an element required to secure good melt flowability because, for cast steel materials, the melt needs to flow into all the corners of the mold. However, since Si has the effect of causing a reduction in toughness and high-temperature strength and, moreover, promoting the formation of δ-ferrite, it is necessary to minimize its content. If its content is less than 0.05%, sufficient melt flowability cannot be obtained, whereas if its content is greater than 0.3%, difficulties as described above will manifest themselves. Accordingly, the content of Si should be in the range of 0.05 to 0.3%. The preferred range is from 0.1 to 0.25%.

Mn (manganese): Mn is an element which is useful as a deoxidizer. Moreover, Mn has the effect of inhibiting the formation of δ-ferrite. On the other hand, the addition of a large amount of this element will cause a reduction in creep rupture strength. Consequently, the addition of more than 1% of Mn is undesirable. However, regarding forging at the stage of steel making, a Mn content of not less than 0.1% is advantageous from the viewpoint of cost because scrap is more easily controlled is more easily controlled. Accordingly, the content of Mn should be in the range of 0.1 to 1%.

Cr (chromium): Cr form a carbide and thereby contributes to the improvement of creep rupture strength. Moreover, Cr dissolves in the matrix to improve oxidation resistance and also contributes to the improvement of longtime high-temperature strength by strengthening the matrix itself. If its content is less than 8%, no sufficient effect will be produced, while if its content is greater than 10%, the formation of δ-ferrite will tend to occur and cause a reduction in strength and toughness. Accordingly, the content of Cr should be in the range of 8 to 10%. The preferred range is from 8.5 to 9.5%.

Ni (nickel): Ni is an element which is effective in improving toughness. Moreover, Ni also has the effect of reducing the Cr equivalent and thereby inhibiting the formation of δ-ferrite. However, since the addition of this element may cause a reduction in creep rupture strength, it is desirable to add Ni in a required minimum amount. In the present invention, Co is added as an element for exhibiting the effects of Ni, so that the role of Ni can be performed by Co. However, since Co is an expensive element, it is necessary from an economic point of view to reduce the content of Co as much as possible. Consequently, the formation of δ-ferrite is inhibited by adding not greater than 0.2% of Ni, though this may depend on other alloying elements. Its lower limit is determined to be 0.01% with consideration for the amount of Ni which is usually introduced as an incidental impurity. Accordingly, the content of Ni should be in the range of 0.01 to 0.2%. The preferred range is from 0.01 to 0.1%.

V (vanadium): V forms a carbonitride and thereby improves creep rupture strength. If its content is less than 0.1%, no sufficient effect will be produced. On the other hand, if its content is greater than 0.3%, the creep rupture strength will be reduced. Accordingly, the content of V should be in the range of 0.1 to 0.3%. The preferred range is from 0.15 to 0.25%.

Nb (niobium) and Ta (tantalum): Nb and Ta form carbonitrides and thereby contribute to the improvement of high-temperature strength. Moreover, they cause finer carbides ($M_{23}C_6$) to precipitate at high temperatures and thereby contribute to the improvement of long-time creep rupture strength. If their total content is less than 0.01% by weight, no sufficient effect will be produced. On the other hand, if their total content is greater than 0.2% by weight, the carbides of Nb and Ta formed during the manufacture of steel ingots will fail to dissolve fully in the matrix during heat treatment, resulting in a reduction in toughness. Accordingly, the total content of Nb and Ta should be in the range of 0.01 to 0.2%. The preferred range is from 0.03 to 0.07%.

Mo (molybdenum): Mo, together with W, dissolves in the matrix and thereby improves creep rupture strength. If Mo is added alone, it may be used in an amount of about 1.5%. However, where W is also added as is the case with the present invention, W is more effective in improving high-temperature strength. Moreover, if Mo and W are added in unduly large amounts, δ-ferrite will be formed to cause a reduction in creep rupture strength. Since the addition of W alone fails to give sufficient high-temperature strength, at least a slight amount of Mo needs to be added. That is, the content of Mo should not be less than 0.1% in this cast steel. Accordingly, with consideration for a balance with the content of W, the content of Mo should be in the range of 0.1 to 0.7%. The preferred range is from 0.1 to 0.5%.

W (tungsten): As described above, W, together with Mo, dissolves in the matrix and thereby improves creep rupture strength. W is an element which exhibits a more powerful solid solution strengthening effect than Mo and is hence effective in improving high-temperature strength. However, if W is added in an unduly large amount, δ-ferrite and a large quantity of Laves phase will be formed to cause a reduction in creep rupture strength. Accordingly, with consideration for a balance with the content of Mo, the content of W should be in the range of 1 to 2.5%. The preferred range is from 1.5 to 2%.

Co (cobalt): Co dissolves in the matrix to inhibit the formation of δ-ferrite. Although Co has the function of inhibiting the formation of δ-ferrite like Ni, Co does not reduce high-temperature strength as contrasted with Ni. Consequently, if Co is added, strengthening elements (e.g., Cr, W and Mo) may be added in larger amounts than in the case where no Co is added. As a result, high creep rupture strength can be achieved. Furthermore, Co also has the effect of enhancing resistance to temper softening and is hence effective in minimizing the softening of the material during use. These effects are manifested by adding Co in an amount of not less than 0.1%, though it may depend on the contents of other elements. However, in the compositional system of the heat-resisting cast steel of the present invention, the addition of more than 5% of Co tends to induce the formation of intermetallic compounds such as a phase. Once such intermetallic compounds are formed, the material will become brittle. In addition, this will also lead to a reduction in long-time creep rupture strength. Accordingly, the content of Co should be in the range of 0.1 to 5%. The preferred range is from 2 to 4%.

N (nitrogen): N, together with C and alloying elements, forms carbonitrides and thereby contributes to the improvement of high-temperature strength. In this compositional system, if its content is less than 0.03%, sufficient amount of carbonitrides cannot be formed and, therefore, no sufficient creep rupture strength will be achieved. On the other hand, if its content is greater than 0.07%, the carbonitrides will aggregate to form coarse grains after the lapse of a long time and, therefore, creep rupture strength is insufficient. Accordingly, the content of N should be in the range of 0.03 to 0.07%. The preferred range is from 0.04 to 0.06%.

Second Heat-Resisting Cast Steel of the Present Invention

The reasons for content restrictions in the second heat-resisting cast steel of the present invention are described below. However, except for Mn, the reasons are the same as those described in connection with the aforesaid first heat-resisting cast steel and are hence omitted. Here, the reason why the content of Mn is restricted to a narrower range is explained.

Mn: As described above, Mn is an element which is useful as a deoxidizer. Moreover, Mn has the effect of inhibiting the formation of δ-ferrite. However, as described above, the addition of this element causes a reduction in creep rupture strength similarly to Ni. Consequently, it is necessary to minimize the content of Mn. Especially if the content of Mn is restricted to 0.1% or less, creep rupture strength is markedly improved. Furthermore, Mn also reacts with S introduced as an impurity to form MnS and thereby serves to negate the adverse effect of S. For this reason, it is necessary to add Mn in an amount of not less than 0.01% by weight. Accordingly, the content of Mn is restricted to a range of 0.01 to 0.1%. The preferred range is from 0.06 to 0.09%.

Third Heat-Resisting Cast Steel of the Present Invention

The reasons for content restrictions in the third heat-resisting cast steel of the present invention are described below. However, only the reasons why the content of N is altered and B is newly added as compared with the aforesaid first heat-resisting cast steel are explained here.

N: As described above, N, together with C and alloying elements, forms carbonitrides and thereby contributes to the improvement of high-temperature strength. On the other hand, in this heat-resisting cast steel, not only the formation of carbonitrides, but also the addition of B as will be described later is also effective in improving high-temperature strength. However, B combines easily with N in steel to form a nonmetallic inclusion, BN. Consequently, in steel containing N, the effect of B added thereto is negated by N and, therefore, B fails to bring about a sufficient improvement in high-temperature strength. In order to allow the addition of B to exhibit its effect to the fullest extent, the amount of N added must be minimized. Thus, where it is desired to make the most of the effect produced by the addition of B and thereby improve high-temperature strength, the content of N should desirably be not greater than 0.01%. However, where B is added in order to produce an effect which is not necessarily sufficient but serves to supplement the precipitation strengthening effect of carbonitrides, the addition of B can be expected to bring about an improvement in high-temperature strength at an N content of not greater than 0.03%. On the other hand, if the content of N is not less than 0.03%, sufficient high-temperature strength is secured by the formation of carbonitrides as shown in the aforesaid first and second heat-resisting cast steels. Accordingly, in the third heat-resisting cast steel in which high-temperature strength is improved by utilizing the effect of B to some extent, N contents up to 0.03% are allowed in order to minimized the formation of BN. On the other hand, the lower limit of the N content is an inevitably introduced level of not less than 0.001%. Thus, where the addition of B is taken into consideration, the content of N should be in the range of 0.001 to 0.03%. The preferred range is from 0.001 to 0.01%.

B (boron): B has the effect of enhancing grain boundary strength and thereby contributes to the improvement of creep rupture strength. In particular, the third heat-resisting cast steel, which shows an improvement in creep rupture strength, is a material designed so that the effect of B may be exhibited to the utmost extent by limiting the content of N which inhibits the effect of B as has been explained in connection with N. However, if B is added in unduly large amounts exceeding 0.01%, a deterioration in weldability and a reduction in toughness will result. On the other hand, if the content of B is less than 0.002%, it will fail to produce a sufficient effect. Accordingly, the content of B should be in the range of 0.002 to 0.01%. The preferred range is from 0.003 to 0.007%.

Fourth Heat-Resisting Cast Steel of the Present Invention

The composition of the fourth heat-resisting cast steel of the present invention is based on the composition of the first heat-resisting cast steel, except that the content of Mn is restricted to a lower and narrower range for the reason described in connection with the second heat-resisting cast steel and the contents of N and B are defined for the reasons described in connection with the third heat-resisting cast steel. Accordingly, the reasons for content restrictions in the fourth heat-resisting cast steel have already been described and are hence not repeated here.

Fifth Heat-Resisting Cast Steel of the Present Invention

The reasons for content restrictions in the fifth heat-resisting cast steel of the present invention are described below. However, the reasons which have been described in connection with the first to fourth heat-resisting cast steels are not repeated. Here, the reasons why Nd is newly added and the content of Ni is altered as compared with the first to fourth heat-resisting cast steels are explained.

Nd (neodymium): Nd forms a carbide and a nitride which are finely dispersed into the matrix to improve high-temperature strength and, in particular, creep rupture strength. Moreover, it is believed that some Nd dissolves in the matrix and thereby contributes to solid solution strengthening. These effects are useful even when an extremely small amount of Nd is added. In fact, these effects are observed even at an Nd content of 0.001%. However, the addition of an unduly large amount of Nd will detract from the toughness of the material and thereby embrittle it. Accordingly, the content of Nd should be not greater than 0.2%. The preferred range is from 0.005 to 0.015%.

Ni: As described above, Ni is effective in improving toughness. Moreover, Ni also has the effect of reducing the Cr equivalent and thereby inhibiting the formation of δ-ferrite. However, since the addition of this element may cause a reduction in creep rupture strength, the content of Ni is restricted to not greater than 0.2% in the first to fourth heat-resisting cast steels to which no Nd is added. However, Nd is highly effective in improving creep rupture strength and, as described above, high-temperature strength can be improved by adding an extremely small amount of Nd. Consequently, the restriction on the content of Ni can be eased by the addition of Nd. Thus, when Nd is added, the reduction in high-temperature strength can be prevented by Nd even if up to 1% of Ni is added. Its lower limit is set to be 0.01% as described above, with consideration for the amount of Ni which is usually introduced as an incidental impurity. Accordingly, the content of Ni should be in the range of 0.01 to 1%. The preferred range is from 0.01 to 0.7%.

Sixth Heat-Resisting Cast Steel of the Present Invention

The reasons for content restrictions in the sixth heat-resisting cast steel of the present invention are described below. However, the reasons which have been described in connection with the aforesaid first to fourth heat-resisting cast steels are not repeated. Here, the reasons why Hf is newly added and the content of Ni is altered as compared with the first to fourth heat-resisting cast steels are explained.

Hf (hafnium): Hf is an alloying element which is added to nickel-base superalloys and the like, and is highly effective in enhancing grain boundary strength to bring about an improvement in high-temperature strength and, in particular, creep rupture strength. This effect of Hf is also useful in improving the high-temperature strength of heat-resisting cast steel materials. In particular, Hf is highly effective in improving creep rupture strength. In addition to the above-described effect, Hf has the effect of improving the long-time creep rupture strength of high-Cr steels, for example, by dissolving in the matrix to strengthen the matrix itself, retarding the aggregation and coarsening of carbides, and forming a fine carbide and thereby contributing to precipitation strengthening. These effects are useful even when an extremely small amount of Hf is added. In fact, these effects are observed even at an Hf content of 0.001%. However, the addition of an unduly large amount of Hf will detract from the toughness of the material and thereby embrittle it. Moreover, if more than 0.2% of Hf is added, it will fail to dissolve in the matrix during preparation, so that no additional effect cannot be expected. In addition, such a large amount of Hf will react with the refractories to form inclusions, thus reducing the purity of the material itself and causing damage to the melting furnace. Consequently, Hf must be added in a required minimum amount. For the above-described reasons, the content of Hf should be in the range of 0.001 to 0.2%. The preferred range is from 0.005 to 0.015%.

Ni: As described above, Ni is effective in improving toughness. Moreover, Ni also has the effect of reducing the Cr equivalent and thereby inhibiting the formation of δ-ferrite. However, since the addition of this element may cause a reduction in creep rupture strength, the content of Ni is restricted to not greater than 0.2% in the first to fourth heat-resisting cast steels to which no Hf is added. However, like Nd, Hf is highly effective in improving creep rupture strength and, as described above, high-temperature strength can be improved by adding an extremely small amount of Hf. Consequently, the restriction on the content of Ni can also be relaxed by the addition of Hf. Thus, when Hf is added, the reduction in high-temperature strength can be prevented by Hf even if up to 1% of Ni is added. That is, the content of Ni should be not greater than 1%. Its lower limit is set to be 0.01% as described above, with consideration for the amount of Ni which is usually introduced as an incidental impurity. Accordingly, the content of Ni should be in the range of 0.01 to 1%. The preferred range is from 0.01 to 0.7%.

Seventh Heat-Resisting Cast Steel of the Present Invention

The composition of the seventh heat-resisting cast steel of the present invention is based on the composition of any of the aforesaid first to fourth heat-resisting cast steels, except that Nd is added for the reason described in connection with the fifth heat-resisting cast steel and Hf is added for the reason described in connection with the sixth heat-resisting cast steel.

Accordingly, only the reason why the content of N is altered as compared with the first to sixth heat-resisting cast steels is explained here.

Ni: As described previously, the addition of Nd or Hf alone permits the upper limit of the Ni content to be increased to 1% without detracting from the high-temperature strength. The seventh heat-resisting cast steel involves the combined addition of Nd and Hf, and hence shows a greater improvement in high-temperature strength. Consequently, the high-temperature strength properties desired in the present invention are not detracted from even if the upper limit of the Ni content is increased to 1%. Accordingly, the content of Ni should be in the range of 0.01 to 1%. The preferred range is from 0.01 to 1%.

Eighth Heat-Resisting Cast Steel of the Present Invention

The eighth heat-resisting cast steel of the present invention is any of the aforesaid first to seventh heat-resisting cast steels wherein the above-defined index A is 8% or less. The reason why the index A is restricted to 8% or less is that, since the present invention relates to cast steel materials in which heat treatment alone, and not mechanical working, is relied on for diffusion, it is necessary to inhibit the formation of δ-ferrite positively by holding down this index A.

EXAMPLES

Example 1

Example 1 is specifically described below.

The chemical compositions of the test materials used therein are shown in Table 1. It is to be understood that the inventive materials (1) used in this Example 1 correspond to the aforesaid first heat-resisting cast steel. Similarly, the inventive materials (2) used in Example 2 correspond to the second heat-resisting cast steel, and so on.

All test materials were prepared by melting the components in a 50 kg vacuum high-frequency furnace and pouring the resulting melt into a sand mold. Prior to use for various testing purposes, these test materials were subjected to a hardening treatment under conditions which simulated the central part of an air-quenched steam turbine casing having a thickness of 400 mm. Then, they were tempered at their respective tempering temperatures which had been determined so as to give a 0.2% yield strength of about 63–68 kgf/mm$^2$.

The mechanical properties of inventive materials (1) and comparative materials, and their creep rupture test results (i.e., creep rupture times measured under the test conditions of 650° C.×13 kgf/mm$^2$) are shown in Table 2. As is evident from the results of room-temperature tension tests, the ductility (as expressed by elongation and reduction in area) and impact value of the inventive materials (1) are stably higher, indicating their good weldability. Moreover, it can be seen that the creep rupture strength of the inventive materials (1) is superior to that of the comparative materials.

In the as-cast state (i.e., the state not subjected to any heat treatment), the microstructure of each 50 kg test material on the casting top side of its main body was observed under an optical microscope to examine the degree of formation of δ-ferrite. The results of observation are summarized in Table 3. As contrasted with some comparative materials, no formation of δ-ferrite was noticed in the inventive materials (1), indicating that they had a good microstructure.

Example 2

Example 2 is specifically described below.

The chemical compositions of inventive materials (2) used for testing purposes are summarized in Table 4. The compositions of the inventive materials (2) are based on the compositions of the inventive materials (1) used in Example 1. That is, material No. 21 was obtained by reducing the content of Mn in material No. 1, and material No. 22 was obtained by reducing the content of Mn in material No. 2. Similarly, the compositions of other inventive materials (2) were determined on the basis of the compositions of the corresponding inventive materials (1). However, the contents of various components in the inventive materials (2) are not exactly the same as those in the corresponding inventive materials (1) because they may vary with the melting process.

All test materials were prepared by melting the components in a 50 kg vacuum high-frequency furnace and pouring the resulting melt into a sand mold. Prior to use for various testing purposes, these test materials were subjected to a hardening treatment under conditions which simulated the central part of an air-quenched steam turbine casing having a thickness of 400 mm. Then, they were tempered at their respective tempering temperatures which had been set so as to give a 0.2% yield strength of about 63–68 kgf/mm$^2$.

In Table 5, the mechanical properties and creep rupture test results (i.e., creep rupture times measured under the test conditions of 650° C.×13 kgf/mm$^2$) of the inventive materials (2) tested in Example 2 are shown in comparison with those of the corresponding inventive materials (1) tested in Example 1. The inventive materials (2) do not differ appreciably in mechanical properties from the corresponding inventive materials (1). On the other hand, the inventive materials (2) show an increase in creep rupture time over the corresponding inventive materials (1), indicating an improvement in creep rupture strength. It is believed that this improvement was achieved by reducing the content of Mn.

When the microstructure of the inventive materials (2) was observed under an optical microscope, no formation of δ-ferrite was noticed as was the case with the inventive materials (1) tested in Example 1.

Example 3

Example 3 is specifically described below.

The chemical compositions of inventive materials (3) used for testing purposes are summarized in Table 6. Similarly to the inventive materials (2), the compositions of the inventive materials (3) are based on the compositions of the inventive materials (1), except that the content of N is reduced as compared with the inventive materials (1) and B is added thereto. Specifically, material No. 31 was obtained by reducing the content of N in material No. 1 and adding B thereto. The compositions of other inventive materials (3) were determined in the same manner as described above.

All test materials were prepared by melting the components in a 50 kg vacuum high-frequency furnace and pouring the resulting melt into a sand mold. Prior to use for various testing purposes, these test materials were subjected to a hardening treatment under conditions which simulated the central part of an air-quenched steam turbine casing having a thickness of 400 mm. Then, they were tempered at their respective tempering temperatures which had been determined so as to give a 0.2% yield strength of about 63–68 kgf/mm$^2$.

In Table 7, the mechanical properties and creep rupture test results (i.e., creep rupture times measured under the test conditions of 650° C.×13 kgf/mm$^2$) of the inventive materials (3) tested in Example 3 are shown in comparison with those of the corresponding inventive materials (1) tested in Example 1. The inventive materials (3) do not differ appreciably in mechanical properties from the corresponding inventive materials (1). On the other hand, the inventive materials (3) show a slight increase in creep rupture time over the corresponding inventive materials (1), indicating a slight improvement in creep rupture strength. It is believed that this improvement was achieved by the addition of B.

When the microstructure of the inventive materials (3) was observed under an optical microscope, no formation of δ-ferrite was noticed as was the case with the inventive materials (1) and (2) tested in Examples 1 and 2.

Example 4

Example 4 is specifically described below.

The chemical compositions of inventive materials (4) used for testing purposes are summarized in Table 8. Similarly to the inventive materials (3), the compositions of the inventive materials (4) are based on the compositions of the inventive materials (2), except that the content of N is reduced as compared with the inventive materials (2) and B is added thereto. Specifically, material No. 41 was obtained by reducing the content of N in material No. 21 and adding B thereto. The compositions of other inventive materials (4) were determined in the same manner as described above.

All test materials were prepared by melting the components in a 50 kg vacuum high-frequency furnace and pouring the resulting melt into a sand mold. Prior to use for various testing purposes, these test materials were subjected to a hardening treatment under conditions which simulated the central part of an air-quenched steam turbine casing having a thickness of 400 mm. Then, they were tempered at their respective tempering temperatures which had been determined so as to give a 0.2% yield strength of about 63–68 kgf/mm$^2$.

In Table 9, the mechanical properties and creep rupture test results (i.e., creep rupture times measured under the test conditions of 650° C.×13 kgf/mm$^2$) of the inventive materials (4) tested in Example 4 are shown in comparison with those of the corresponding inventive materials (2) tested in Example 2. The inventive materials (4) do not differ appreciably in mechanical properties from the corresponding inventive materials (2). On the other hand, the inventive materials (4) show a slight increase in creep rupture time over the corresponding inventive materials (2), indicating a slight improvement in creep rupture strength. It is believed that this improvement was achieved by the addition of B.

When the microstructure of the inventive materials (4) was observed under an optical microscope, no formation of δ-ferrite was noticed as was the case with the inventive materials (1) to (3) tested in Examples 1 to 3.

Example 5

Example 5 is specifically described below.

The chemical compositions of inventive materials (5) used for testing purposes are summarized in Table 10. The compositions of the inventive materials (5) are based on the compositions of inventive materials (1) to (4), except that a very small amount of Nd is added to the respective materials. Specifically, material Nos. 51 and 52 were obtained by adding Nd to material Nos. 1 and 2, respectively. Similarly, material Nos. 53, 54, 55, 56, 57 and 58 were obtained by adding Nd to material Nos. 22, 23, 34, 35, 41 and 42, respectively. Material Nos. 59 and 60, which are materials used to examine the influence of the Ni content, were obtained by increasing the content of Ni in material Nos. 22 and 41, respectively. However, as described in Examples 2 to 4, the contents of various components in the inventive materials (5) are not exactly the same as those in the corresponding inventive materials (1) to (4) because they may vary with the melting process.

All test materials were prepared by melting the components in a 50 kg vacuum high-frequency furnace and pouring the resulting melt into a sand mold. Prior to use for various testing purposes, these test materials were subjected to a hardening treatment under conditions which simulated the central part of an air-quenched steam turbine casing having a thickness of 400 mm. Then, they were tempered at their respective tempering temperatures which had been determined so as to give a 0.2% yield strength of about 63–68 kgf/mm$^2$.

In Table 11, the mechanical properties and creep rupture test results (i.e., creep rupture times measured under the test conditions of 650° C.×13 kgf/mm$^2$) of the inventive materials (5) tested in Example 5 are shown in comparison with those of the corresponding inventive materials (1) to (4) tested in Examples 1 to 4. The inventive materials (5) do not differ appreciably in room-temperature tensile properties from the corresponding inventive materials (1) to (4). Moreover, the inventive materials (5) show a slight reduction in impact value as a result of the addition of a very small amount of Nd, but this reduction is unworthy of serious consideration. On the other hand, the inventive materials (5) show an increase in creep rupture time over the corresponding inventive materials (1) to (4), indicating that the addition of Nd brings about an improvement in creep rupture strength.

When the microstructure of the inventive materials (5) was observed under an optical microscope, no formation of δ-ferrite was noticed as was the case with the inventive materials (1) to (4) tested in Examples 1 to 4.

Example 6

Example 6 is specifically described below.

The chemical compositions of inventive materials (6) used for testing purposes are summarized in Table 12. The compositions of the inventive materials (6) are based on the compositions of inventive materials (1) to (4), except that a very small amount of Hf is added to the respective materials. Specifically, material Nos. 61 and 62 were obtained by adding Hf to material Nos. 1 and 2, respectively. Similarly, material Nos. 63, 64, 65, 66, 67 and 68 were obtained by adding Hf to material Nos. 22, 23, 34, 35, 41 and 42, respectively. Material Nos. 69 and 70, which are materials used to examine the influence of the Ni content, were obtained by increasing the content of Ni in material Nos. 22 and 41, respectively. However, as described in Examples 2 to 5, the contents of various components in the inventive materials (6) are not exactly the same as those in the corresponding inventive materials (1) to (4) because they may vary with the melting process.

All test materials were prepared by melting the components in a 50 kg vacuum high-frequency furnace and pouring the resulting melt into a sand mold. Prior to use for various testing purposes, these test materials were subjected to a hardening treatment under conditions which simulated the central part of an air-quenched steam turbine casing having a thickness of 400 mm. Then, they were tempered at their respective tempering temperatures which had been determined so as to give a 0.2% yield strength of about 63–68 kgf/mm$^2$.

In Table 13, the mechanical properties and creep rupture test results (i.e., creep rupture times measured under the test conditions of 650° C.×13 kgf/mm$^2$) of the inventive materials (6) tested in Example 6 are shown in comparison with those of the corresponding inventive materials (1) to (4) tested in Examples 1 to 4. The inventive materials (6) do not differ appreciably in room-temperature tensile properties from the corresponding inventive materials (1) to (4).

Moreover, the inventive materials (6) show a slight reduction in impact value as a result of the addition of a very small amount of Hf, but this reduction is unworthy of serious consideration as is the case with the inventive materials (5). On the other hand, the inventive materials (6) show an increase in creep rupture time over the corresponding inventive materials (1) to (4), indicating that the addition of Hf brings about an improvement in creep rupture strength.

When the microstructure of the inventive materials (6) was observed under an optical microscope, no formation of δ-ferrite was noticed as was the case with the inventive materials (1) to (5) tested in Examples 1 to 5.

Example 7

Example 7 is specifically described below.

The chemical compositions of inventive materials (7) used for testing purposes are summarized in Table 14. The compositions of the inventive materials (7) are based on the compositions of inventive materials (1) to (4), except that very small amounts of Hf and Nd are added to the respective materials. Specifically, material Nos. 71 and 72 were obtained by adding Nd and Hf to material Nos. 1 and 2, respectively. Similarly, material Nos. 73, 74, 75, 76, 77 and 78 were obtained by adding Nd and Hf to material Nos. 22, 23, 34, 35, 41 and 42, respectively. Material Nos. 79 and 80, which are materials used to examine the influence of the Ni content, were obtained by increasing the content of Ni in material Nos. 22 and 41, respectively. However, as described in Examples 2 to 6, the contents of various components in the inventive materials (7) are not exactly the same as those in the corresponding inventive materials (1) to (4) because they may vary with the melting process.

All test materials were prepared by melting the components in a 50 kg vacuum high-frequency furnace and pouring the resulting melt into a sand mold. Prior to use for various testing purposes, these test materials were subjected to a hardening treatment under conditions which simulated the central part of an air-quenched steam turbine casing having a thickness of 400 mm. Then, they were tempered at their respective tempering temperatures which had been determined so as to give a 0.2% yield strength of about 63–68 kgf/mm$^2$.

In Table 15, the mechanical properties and creep rupture test results (i.e., creep rupture times measured under the test conditions of 650° C.×13 kgf/mm$^2$) of the inventive materials (7) tested in Example 7 are shown in comparison with those of the corresponding inventive materials (1) to (4) tested in Examples 1 to 4. The inventive materials (7) do not differ appreciably in room-temperature tensile properties from the corresponding inventive materials (1) to (4). Moreover, the inventive materials (7) show a slight reduction in impact value as a result of the addition of very small amounts of Nd and Hf, but this reduction is unworthy of serious consideration as is the case with the inventive materials (5) and (6). On the other hand, the inventive materials (7) show an increase in creep rupture time over the corresponding inventive materials (1) to (4). The combined addition of Nd and Hf causes a slight reduction in toughness, but this reduction is unworthy of serious consideration. Rather, it can be seen that the combined addition of Nd and Hf brings about a marked improvement in creep rupture strength.

When the microstructure of the inventive materials (7) was observed under an optical microscope, no formation of δ-ferrite was noticed as was the case with the inventive materials (1) to (6) tested in Examples 1 to 6.

Example 8

Example 8 is specifically described below.

The previously defined index A was calculated with respect to each of the above-described inventive materials (1) to (7) and the comparative materials, and the results thus obtained are summarized in Tables 16 to 19. It is evident from these tables that the index A was 8% or less for all of the inventive materials (1) to (7). In contrast, the index A is greater than for some comparative materials (i.e., material Nos. 6, 7, 11 and 16). It can be seen by reference to Table 3 that the formation of δ-ferrite was observed in these comparative materials.

TABLE 1

| Material No. | | C | Si | Mn | Cr | Ni | V | Nb | Ta | Mo | W | Co | N |
|---|---|---|---|---|---|---|---|---|---|---|---|---|---|
| Inventive materials (1) | 1 | 0.12 | 0.15 | 0.25 | 9.1 | 0.11 | 0.15 | 0.05 | — | 0.10 | 2.2 | 2.9 | 0.050 |
| | 2 | 0.14 | 0.25 | 0.55 | 9.5 | 0.04 | 0.12 | 0.05 | 0.13 | 0.65 | 1.5 | 3.1 | 0.032 |
| | 3 | 0.11 | 0.06 | 0.95 | 8.1 | 0.15 | 0.13 | 0.01 | 0.05 | 0.35 | 1.2 | 0.2 | 0.065 |
| | 4 | 0.10 | 0.10 | 0.85 | 9.1 | 0.15 | 0.16 | — | 0.12 | 0.16 | 1.8 | 1.5 | 0.068 |
| | 5 | 0.08 | 0.14 | 0.33 | 9.6 | 0.18 | 0.14 | 0.02 | 0.04 | 0.15 | 2.4 | 4.6 | 0.051 |
| Comparative materials | 6 | 0.11 | 0.61 | 0.40 | 9.0 | 0.82 | 0.15 | — | — | 0.40 | 1.8 | 1.5 | 0.052 |
| | 7 | 0.16 | 0.25 | 1.21 | 10.2 | 0.10 | 0.14 | 0.05 | — | 0.41 | 1.7 | — | 0.032 |
| | 8 | 0.18 | 0.10 | 0.45 | 9.6 | 0.25 | 0.16 | — | — | 0.31 | 1.8 | 1.5 | 0.105 |
| | 9 | 0.12 | 0.15 | 0.43 | 9.1 | 0.10 | 0.25 | 0.05 | — | 0.30 | 1.7 | 2.0 | 0.084 |
| | 10 | 0.14 | 0.10 | 1.11 | 9.3 | 0.25 | 0.05 | — | 0.05 | 0.05 | 2.4 | 2.1 | 0.051 |
| | 11 | 0.08 | 0.45 | 0.54 | 10.8 | 0.65 | 0.15 | 0.05 | 0.20 | 0.31 | 2.3 | 2.5 | 0.053 |
| | 12 | 0.20 | 0.22 | 0.55 | 8.5 | 0.12 | 0.35 | — | 0.06 | 0.50 | 0.5 | 3.5 | 0.035 |
| | 13 | 0.10 | 0.42 | 0.63 | 9.2 | 0.15 | 0.16 | 0.05 | 0.05 | 0.30 | 2.3 | 5.5 | 0.032 |
| | 14 | 0.12 | 0.20 | 0.62 | 9.3 | 0.16 | 0.16 | — | — | 1.21 | 0.5 | 4.5 | 0.061 |
| | 15 | 0.06 | 0.15 | 0.80 | 7.5 | 0.35 | 0.05 | 0.05 | 0.05 | 0.62 | 2.2 | 4.1 | 0.060 |
| | 16 | 0.13 | 0.35 | 1.16 | 9.2 | 0.18 | 0.18 | 0.15 | 0.12 | 0.58 | 3.0 | 3.4 | 0.072 |
| | 17 | 0.25 | 0.10 | 0.80 | 11.1 | 0.18 | 0.17 | 0.02 | 0.08 | 0.55 | 0.8 | 5.0 | 0.061 |
| | 18 | 0.05 | 0.12 | 1.53 | 7.2 | 0.46 | 0.04 | 0.02 | 0.08 | 0.25 | 2.4 | 5.5 | 0.063 |

TABLE 2

| Material No. | | Room-temperature tension test: 0.2% yield strength (kgf/mm$^2$) | Tensile strength (kgf/mm$^2$) | Elongation (%) | Reduction in area (%) | 2 mm V-notched impact test: Impact value (20° C.) (kgf-m) | Creep rupture test Test conditions: 650° C. × 13 kgf/mm$^2$ Rupture time (hours) |
|---|---|---|---|---|---|---|---|
| Inventive materials (1) | 1 | 65.2 | 80.2 | 22.3 | 65.4 | 8.4 | 1504 |
| | 2 | 66.3 | 82.1 | 23.4 | 64.8 | 9.1 | 1412 |
| | 3 | 65.4 | 80.4 | 23.1 | 66.1 | 10.2 | 1056 |
| | 4 | 64.8 | 80.0 | 22.5 | 64.8 | 9.8 | 1120 |
| | 5 | 65.0 | 80.5 | 22.0 | 65.2 | 8.6 | 1497 |
| Comparative materials | 6 | 64.7 | 79.8 | 21.3 | 60.5 | 3.8 | 621 |
| | 7 | 65.0 | 80.4 | 20.4 | 61.4 | 3.2 | 644 |
| | 8 | 65.1 | 80.1 | 17.2 | 55.4 | 3.0 | 723 |
| | 9 | 66.2 | 81.2 | 18.3 | 56.8 | 2.2 | 614 |
| | 10 | 64.7 | 80.6 | 21.2 | 62.6 | 6.8 | 719 |
| | 11 | 65.0 | 80.8 | 17.2 | 57.4 | 2.5 | 721 |
| | 12 | 66.4 | 81.5 | 17.2 | 55.4 | 2.6 | 754 |
| | 13 | 67.1 | 82.4 | 18.3 | 58.4 | 3.6 | 1022 |
| | 14 | 65.3 | 80.2 | 21.2 | 60.8 | 7.2 | 822 |
| | 15 | 65.1 | 79.8 | 20.1 | 61.1 | 6.8 | 616 |
| | 16 | 64.8 | 81.0 | 19.8 | 59.8 | 6.5 | 628 |
| | 17 | 65.0 | 80.2 | 22.2 | 61.4 | 3.8 | 681 |
| | 18 | 65.1 | 81.1 | 21.8 | 60.5 | 6.4 | 648 |

TABLE 3

| Material No. | Content of δ-ferrite (%) |
|---|---|
| Inventive materials (1) | |
| 1 | 0.00 |
| 2 | 0.00 |
| 3 | 0.00 |
| 4 | 0.00 |
| 5 | 0.00 |
| Comparative Materials | |
| 6 | 0.18 |
| 7 | 0.60 |
| 8 | 0.00 |
| 9 | 0.00 |
| 10 | 0.00 |
| 11 | 0.74 |
| 12 | 0.00 |
| 13 | 0.00 |
| 14 | 0.00 |
| 15 | 0.00 |
| 16 | 0.23 |
| 17 | 0.00 |
| 18 | 0.00 |

TABLE 4

| Material No. | | C | Si | Mn | Cr | Ni | V | Nb | Ta | Mo | w | Co | N |
|---|---|---|---|---|---|---|---|---|---|---|---|---|---|
| Inventive materials (1) | 1 | 0.12 | 0.15 | 0.25 | 9.1 | 0.11 | 0.15 | 0.05 | — | 0.10 | 2.2 | 2.9 | 0.050 |
| | 2 | 0.14 | 0.25 | 0.55 | 9.5 | 0.04 | 0.12 | 0.05 | 0.13 | 0.65 | 1.5 | 3.1 | 0.032 |
| | 3 | 0.11 | 0.06 | 0.95 | 8.1 | 0.15 | 0.13 | 0.01 | 0.05 | 0.35 | 1.2 | 0.2 | 0.065 |
| | 4 | 0.10 | 0.10 | 0.85 | 9.1 | 0.15 | 0.16 | — | 0.12 | 0.16 | 1.8 | 1.5 | 0.068 |
| | 5 | 0.08 | 0.14 | 0.33 | 9.6 | 0.18 | 0.14 | 0.02 | 0.04 | 0.15 | 2.4 | 4.6 | 0.051 |
| Inventive materials (2) | 21 | 0.12 | 0.15 | 0.06 | 9.2 | 0.11 | 0.16 | 0.05 | — | 0.10 | 2.2 | 3.0 | 0.049 |
| | 22 | 0.14 | 0.23 | 0.08 | 9.4 | 0.05 | 0.12 | 0.05 | 0.10 | 0.63 | 1.5 | 3.3 | 0.033 |
| | 23 | 0.11 | 0.05 | 0.09 | 8.1 | 0.18 | 0.13 | 0.01 | 0.04 | 0.29 | 1.0 | 0.2 | 0.067 |
| | 24 | 0.12 | 0.07 | 0.09 | 8.9 | 0.18 | 0.16 | — | 0.11 | 0.16 | 1.8 | 1.3 | 0.068 |
| | 25 | 0.08 | 0.14 | 0.03 | 9.6 | 0.19 | 0.14 | 0.02 | 0.04 | 0.16 | 2.5 | 4.6 | 0.051 |

TABLE 5

| Material No. | | Room-temperature tension test: 0.2% yield strength (kgf/mm$^2$) | Tensile strength (kgf/mm$^2$) | Elongation (%) | Reduction in area (%) | 2 mm V-notched impact test: Impact value (20° C.) (kgf-m) | Creep rupture test Test conditions: 650° C. × 13 kgf/mm$^2$ Rupture time (hours) |
|---|---|---|---|---|---|---|---|
| Inventive materials (1) | 1 | 65.2 | 80.2 | 22.3 | 65.4 | 8.4 | 1504 |
| | 2 | 66.3 | 82.1 | 23.4 | 64.8 | 9.1 | 1412 |
| | 3 | 65.4 | 80.4 | 23.1 | 66.1 | 10.2 | 1056 |
| | 4 | 64.8 | 80.0 | 22.5 | 64.8 | 9.8 | 1120 |
| | 5 | 65.0 | 80.5 | 22.0 | 65.2 | 8.6 | 1497 |
| Iventive materials (2) | 21 | 65.5 | 80.4 | 22.8 | 66.6 | 7.9 | 1912 |
| | 22 | 64.7 | 80.0 | 21.4 | 64.5 | 8.9 | 1816 |
| | 23 | 66.3 | 82.1 | 23.5 | 67.8 | 10.4 | 1421 |
| | 24 | 67.5 | 82.4 | 22.1 | 66.9 | 9.9 | 1427 |
| | 25 | 65.2 | 80.6 | 22.4 | 65.5 | 8.9 | 1788 |

TABLE 6

| Material No. | | C | Si | Mn | Cr | Ni | V | Nb | Ta | Mo | W | Co | N | B |
|---|---|---|---|---|---|---|---|---|---|---|---|---|---|---|
| Inventive materials (1) | 1 | 0.12 | 0.15 | 0.25 | 9.1 | 0.11 | 0.15 | 0.05 | — | 0.10 | 2.2 | 2.9 | 0.050 | — |
| | 2 | 0.14 | 0.25 | 0.55 | 9.5 | 0.04 | 0.12 | 0.05 | 0.13 | 0.65 | 1.5 | 3.1 | 0.032 | — |
| | 3 | 0.11 | 0.06 | 0.95 | 8.1 | 0.15 | 0.13 | 0.01 | 0.05 | 0.35 | 1.2 | 0.2 | 0.065 | — |
| | 4 | 0.10 | 0.10 | 0.85 | 9.1 | 0.15 | 0.16 | — | 0.12 | 0.16 | 1.8 | 1.5 | 0.068 | — |
| | 5 | 0.08 | 0.14 | 0.33 | 9.6 | 0.18 | 0.14 | 0.02 | 0.04 | 0.15 | 2.4 | 4.6 | 0.051 | — |
| Inventive materials (3) | 31 | 0.12 | 0.14 | 0.26 | 9.0 | 0.11 | 0.15 | 0.05 | — | 0.09 | 2.1 | 3.0 | 0.009 | 0.005 |
| | 32 | 0.14 | 0.24 | 0.55 | 9.4 | 0.05 | 0.13 | 0.04 | 0.12 | 0.64 | 1.4 | 3.1 | 0.005 | 0.004 |
| | 33 | 0.12 | 0.05 | 0.96 | 8.0 | 0.15 | 0.12 | 0.01 | 0.05 | 0.36 | 1.1 | 0.2 | 0.024 | 0.009 |
| | 34 | 0.11 | 0.09 | 0.84 | 9.0 | 0.16 | 0.15 | — | 0.11 | 0.16 | 1.6 | 1.4 | 0.028 | 0.008 |
| | 35 | 0.09 | 0.13 | 0.33 | 9.6 | 0.18 | 0.14 | 0.01 | 0.04 | 0.14 | 2.4 | 4.6 | 0.014 | 0.003 |

TABLE 7

| Material No. | | Room-temperature tension test: 0.2% yield strength (kgf/mm$^2$) | Tensile strength (kgf/mm$^2$) | Elongation (%) | Reduction in area (%) | 2 mm V-notched impact test: Impact value (20° C.) (kgf-m) | Creep rupture test Test conditions: 650° C. × 13 kgf/mm$^2$ Rupture time (hours) |
|---|---|---|---|---|---|---|---|
| Inventive materials (1) | 1 | 65.2 | 80.2 | 22.3 | 65.4 | 8.4 | 1504 |
| | 2 | 66.3 | 82.1 | 23.4 | 64.8 | 9.1 | 1412 |
| | 3 | 65.4 | 80.4 | 23.1 | 66.1 | 10.2 | 1056 |
| | 4 | 64.8 | 80.0 | 22.5 | 64.8 | 9.8 | 1120 |
| | 5 | 65.0 | 80.5 | 22.0 | 65.2 | 8.6 | 1497 |
| Inventive materials (3) | 31 | 64.6 | 80.3 | 21.4 | 64.8 | 8.3 | 1613 |
| | 32 | 65.2 | 81.4 | 22.3 | 65.7 | 9.2 | 1548 |
| | 33 | 66.7 | 81.8 | 23.4 | 67.5 | 10.5 | 1201 |
| | 34 | 66.3 | 81.5 | 22.8 | 66.3 | 9.9 | 1288 |
| | 35 | 65.2 | 80.8 | 21.4 | 65.2 | 9.0 | 1604 |

TABLE 8

| Material No. | | C | Si | Mn | Cr | Ni | V | Nb | Ta | Mo | W | Co | N | B |
|---|---|---|---|---|---|---|---|---|---|---|---|---|---|---|
| Inventive materials (2) | 21 | 0.12 | 0.15 | 0.06 | 9.2 | 0.11 | 0.16 | 0.05 | — | 0.10 | 2.2 | 3.0 | 0.049 | — |
| | 22 | 0.14 | 0.23 | 0.08 | 9.4 | 0.05 | 0.12 | 0.05 | 0.10 | 0.63 | 1.5 | 3.3 | 0.033 | — |
| | 23 | 0.11 | 0.05 | 0.09 | 8.1 | 0.18 | 0.13 | 0.01 | 0.04 | 0.29 | 1.0 | 0.2 | 0.067 | — |
| | 24 | 0.12 | 0.07 | 0.09 | 8.9 | 0.18 | 0.16 | — | 0.11 | 0.16 | 1.8 | 1.3 | 0.068 | — |
| | 25 | 0.08 | 0.14 | 0.03 | 9.6 | 0.19 | 0.14 | 0.02 | 0.04 | 0.16 | 2.5 | 4.6 | 0.051 | — |
| Inventive materials (4) | 41 | 0.12 | 0.14 | 0.05 | 9.1 | 0.11 | 0.15 | 0.05 | — | 0.10 | 2.0 | 2.9 | 0.008 | 0.006 |
| | 42 | 0.15 | 0.24 | 0.07 | 9.5 | 0.04 | 0.12 | 0.04 | 0.12 | 0.65 | 1.4 | 3.2 | 0.005 | 0.005 |
| | 43 | 0.12 | 0.05 | 0.09 | 8.1 | 0.18 | 0.12 | 0.01 | 0.04 | 0.28 | 0.9 | 0.3 | 0.025 | 0.009 |
| | 44 | 0.13 | 0.06 | 0.09 | 8.9 | 0.19 | 0.16 | — | 0.11 | 0.15 | 1.6 | 1.6 | 0.029 | 0.007 |
| | 45 | 0.08 | 0.14 | 0.04 | 9.5 | 0.17 | 0.14 | 0.02 | 0.04 | 0.16 | 2.4 | 4.6 | 0.0i5 | 0.004 |

TABLE 9

| Material No. | | Room-temperature tension test: 0.2% yield strength (kgf/mm$^2$) | Tensile strength (kgf/mm$^2$) | Elongation (%) | Reduction in area (%) | 2 mm V-notched impact test: Impact value (20° C.) (kgf-m) | Creep rupture test Test conditions: 650° C. × 13 kgf/mm$^2$ Rupture time (hours) |
|---|---|---|---|---|---|---|---|
| Inventive materials (2) | 21 | 65.5 | 80.4 | 22.8 | 66.6 | 7.9 | 1912 |
| | 22 | 64.7 | 80.0 | 21.4 | 64.5 | 8.9 | 1816 |
| | 23 | 66.3 | 82.1 | 23.5 | 67.8 | 10.4 | 1421 |
| | 24 | 67.5 | 82.4 | 22.1 | 66.9 | 9.9 | 1427 |
| | 25 | 65.2 | 80.6 | 22.4 | 65.5 | 8.9 | 1788 |
| Inventive materials (4) | 41 | 64.3 | 80.8 | 21.5 | 65.8 | 8.1 | 2016 |
| | 42 | 64.5 | 81.0 | 22.3 | 64.5 | 8.7 | 1937 |
| | 43 | 66.8 | 81.7 | 23.2 | 66.6 | 9.2 | 1536 |
| | 44 | 65.7 | 81.1 | 22.3 | 67.3 | 9.7 | 1549 |
| | 45 | 66.3 | 81.5 | 23.8 | 66.2 | 8.7 | 1967 |

TABLE 10

| Material No. | | C | Si | Mn | Cr | Ni | V | Nb | Ta | Mo | W | Co | N | B | Nd |
|---|---|---|---|---|---|---|---|---|---|---|---|---|---|---|---|
| Inventive materials (1) | 1 | 0.12 | 0.15 | 0.25 | 9.1 | 0.11 | 0.15 | 0.05 | — | 0.10 | 2.2 | 2.9 | 0.050 | — | — |
| | 2 | 0.14 | 0.25 | 0.55 | 9.5 | 0.04 | 0.12 | 0.05 | 0.13 | 0.65 | 1.5 | 3.1 | 0.032 | — | — |
| Inventive materials (2) | 22 | 0.14 | 0.23 | 0.08 | 9.4 | 0.05 | 0.12 | 0.05 | 0.10 | 0.63 | 1.5 | 3.3 | 0.033 | — | — |
| | 23 | 0.11 | 0.05 | 0.09 | 8.1 | 0.18 | 0.13 | 0.01 | 0.04 | 0.29 | 1.0 | 0.2 | 0.067 | — | — |
| Inventive materials (3) | 34 | 0.11 | 0.09 | 0.84 | 9.0 | 0.16 | 0.15 | — | 0.11 | 0.16 | 1.6 | 1.4 | 0.028 | 0.008 | — |
| | 35 | 0.09 | 0.13 | 0.33 | 9.6 | 0.18 | 0.14 | 0.01 | 0.04 | 0.14 | 2.4 | 4.6 | 0.014 | 0.003 | — |
| Inventive materials (4) | 41 | 0.12 | 0.14 | 0.05 | 9.1 | 0.11 | 0.15 | 0.05 | — | 0.10 | 2.0 | 2.9 | 0.008 | 0.006 | — |
| | 42 | 0.15 | 0.24 | 0.07 | 9.5 | 0.04 | 0.12 | 0.04 | 0.12 | 0.65 | 1.4 | 3.2 | 0.005 | 0.005 | — |
| Inventive materials (5) | 51 | 0.11 | 0.15 | 0.25 | 9.1 | 0.12 | 0.14 | 0.05 | — | 0.10 | 2.1 | 2.9 | 0.052 | — | 0.045 |
| | 52 | 0.13 | 0.24 | 0.55 | 9.4 | 0.04 | 0.12 | 0.05 | 0.13 | 0.64 | 1.6 | 3.1 | 0.033 | — | 0.003 |
| | 53 | 0.14 | 0.25 | 0.07 | 9.5 | 0.04 | 0.13 | 0.04 | 0.13 | 0.63 | 1.5 | 3.1 | 0.031 | — | 0.112 |
| | 54 | 0.11 | 0.05 | 0.09 | 8.2 | 0.18 | 0.14 | 0.01 | 0.04 | 0.30 | 1.1 | 0.3 | 0.068 | — | 0.089 |
| | 55 | 0.12 | 0.10 | 0.85 | 9.0 | 0.15 | 0.15 | — | 0.12 | 0.16 | 1.5 | 1.3 | 0.027 | 0.007 | 0.148 |
| | 56 | 0.08 | 0.16 | 0.33 | 9.6 | 0.18 | 0.14 | 0.02 | 0.04 | 0.14 | 2.3 | 4.6 | 0.013 | 0.003 | 0.182 |
| | 57 | 0.12 | 0.14 | 0.06 | 9.1 | 0.11 | 0.14 | 0.05 | — | 0.11 | 2.1 | 3.0 | 0.009 | 0.005 | 0.076 |
| | 58 | 0.14 | 0.24 | 0.07 | 9.3 | 0.04 | 0.13 | 0.04 | 0.12 | 0.65 | 1.4 | 3.3 | 0.006 | 0.005 | 0.044 |
| | 59 | 0.13 | 0.22 | 0.08 | 9.4 | 0.65 | 0.12 | 0.04 | 0.09 | 0.58 | 1.6 | 3.3 | 0.031 | — | 0.102 |
| | 60 | 0.13 | 0.13 | 0.06 | 9.0 | 0.88 | 0.15 | 0.05 | — | 0.11 | 2.1 | 2.9 | 0.009 | 0.005 | 0.113 |

TABLE 11

| Material No. | | Room-temperature tension test: 0.2% yield strength (kgf/mm$^2$) | Tensile strength (kgf/mm$^2$) | Elongation (%) | Reduction in area (%) | 2 mm V-notched impact test: Impact value (20° C.) (kgf-m) | Creep rupture test Test conditions: 650° C. × 13 kgf/mm$^2$ Rupture time (hours) |
|---|---|---|---|---|---|---|---|
| Inventive materials (1) | 1 | 65.2 | 80.2 | 22.3 | 65.4 | 8.4 | 1504 |
| | 2 | 66.3 | 82.1 | 23.4 | 64.8 | 9.1 | 1412 |
| Inventive materials (2) | 22 | 64.7 | 80.0 | 21.4 | 64.5 | 8.9 | 1818 |
| | 23 | 66.3 | 82.1 | 23.5 | 67.8 | 10.4 | 1421 |
| Inventive materials (3) | 34 | 66.3 | 81.5 | 22.8 | 66.3 | 9.9 | 1288 |
| | 35 | 65.2 | 80.8 | 21.4 | 65.2 | 9.0 | 1604 |
| Inventive materials (4) | 41 | 64.3 | 80.8 | 21.5 | 65.8 | 8.1 | 2016 |
| | 42 | 64.5 | 81.0 | 22.3 | 64.5 | 8.7 | 1937 |
| Inventive materials (5) | 51 | 63.7 | 79.8 | 20.3 | 64.2 | 7.9 | 1715 |
| | 52 | 64.9 | 80.9 | 21.4 | 63.2 | 8.4 | 1838 |
| | 53 | 65.5 | 81.2 | 20.6 | 63.5 | 8.5 | 2084 |
| | 54 | 65.8 | 81.4 | 21.4 | 65.4 | 9.3 | 1678 |
| | 55 | 64.5 | 80.3 | 22.4 | 64.8 | 9.5 | 1521 |
| | 56 | 65.9 | 81.7 | 20.5 | 63.7 | 8.5 | 1837 |
| | 57 | 67.2 | 82.8 | 21.0 | 65.4 | 7.3 | 2239 |
| | 58 | 66.3 | 81.5 | 21.5 | 63.8 | 8.5 | 2187 |
| | 59 | 65.4 | 81.0 | 22.3 | 65.5 | 9.2 | 1845 |
| | 60 | 66.8 | 81.8 | 23.4 | 66.2 | 7.9 | 2024 |

TABLE 12

| Material No. | | C | Si | Mn | Cr | Ni | V | Nb | Ta | Mo | W | Co | N | B | Hf |
|---|---|---|---|---|---|---|---|---|---|---|---|---|---|---|---|
| Inventive | 1 | 0.12 | 0.15 | 0.25 | 9.1 | 0.11 | 0.15 | 0.05 | — | 0.10 | 2.2 | 2.9 | 0.050 | — | — |
| materials (1) | 2 | 0.14 | 0.25 | 0.55 | 9.5 | 0.04 | 0.12 | 0.05 | 0.13 | 0.65 | 1.5 | 3.1 | 0.032 | — | — |
| Inventive | 22 | 0.14 | 0.23 | 0.08 | 9.4 | 0.05 | 0.12 | 0.05 | 0.10 | 0.63 | 1.5 | 3.3 | 0.033 | — | — |
| materials (2) | 23 | 0.11 | 0.05 | 0.09 | 8.1 | 0.18 | 0.13 | 0.01 | 0.04 | 0.29 | 1.0 | 0.2 | 0.067 | — | — |
| Inventive | 34 | 0.11 | 0.09 | 0.84 | 9.0 | 0.16 | 0.15 | — | 0.11 | 0.16 | 1.6 | 1.4 | 0.028 | 0.008 | — |
| materials (3) | 35 | 0.09 | 0.13 | 0.33 | 9.6 | 0.18 | 0.14 | 0.01 | 0.04 | 0.14 | 2.4 | 4.6 | 0.014 | 0.003 | — |
| Inventive | 41 | 0.12 | 0.14 | 0.05 | 9.1 | 0.11 | 0.15 | 0.05 | — | 0.10 | 2.0 | 2.9 | 0.008 | 0.006 | — |
| materials (4) | 42 | 0.15 | 0.24 | 0.07 | 9.5 | 0.04 | 0.12 | 0.04 | 0.12 | 0.65 | 1.4 | 3.2 | 0.005 | 0.005 | — |
| Inventive | 61 | 0.12 | 0.14 | 0.26 | 9.2 | 0.12 | 0.14 | 0.04 | — | 0.11 | 2.2 | 3.0 | 0.051 | — | 0.175 |
| materials (6) | 62 | 0.13 | 0.24 | 0.54 | 9.5 | 0.05 | 0.13 | 0.04 | 0.12 | 0.64 | 1.4 | 3.2 | 0.033 | — | 0.065 |
| | 63 | 0.14 | 0.23 | 0.08 | 9.3 | 0.05 | 0.12 | 0.05 | 0.09 | 0.63 | 1.5 | 3.3 | 0.035 | — | 0.084 |
| | 64 | 0.11 | 0.05 | 0.09 | 8.1 | 0.17 | 0.13 | 0.01 | 0.05 | 0.30 | 1.1 | 0.3 | 0.067 | — | 0.051 |
| | 65 | 0.12 | 0.12 | 0.83 | 9.1 | 0.16 | 0.14 | — | 0.10 | 0.15 | 1.5 | 1.5 | 0.027 | 0.007 | 0.005 |
| | 66 | 0.08 | 0.15 | 0.32 | 9.5 | 0.18 | 0.14 | 0.01 | 0.04 | 0.14 | 2.4 | 4.6 | 0.015 | 0.003 | 0.121 |
| | 67 | 0.12 | 0.14 | 0.05 | 9.1 | 0.12 | 0.14 | 0.06 | — | 0.11 | 2.0 | 3.0 | 0.008 | 0.005 | 0.093 |
| | 68 | 0.14 | 0.17 | 0.08 | 9.4 | 0.05 | 0.13 | 0.05 | 0.10 | 0.65 | 1.5 | 3.2 | 0.006 | 0.006 | 0.136 |
| | 69 | 0.14 | 0.22 | 0.08 | 9.3 | 0.63 | 0.13 | 0.05 | 0.10 | 0.64 | 1.4 | 3.3 | 0.032 | — | 0.111 |
| | 70 | 0.13 | 0.14 | 0.06 | 9.1 | 0.85 | 0.14 | 0.05 | — | 0.10 | 2.1 | 3.0 | 0.007 | 0.006 | 0.105 |

TABLE 13

| | | Room-temperature tension test | | | | 2 mm V-notched impact test | Creep rupture test Test conditions: |
|---|---|---|---|---|---|---|---|
| Material No. | | 0.2% yield strength (kgf/mm$^2$) | Tensile strength (kgf/mm$^2$) | Elongation (%) | Reduction in area (%) | Impact value (20° C.) (kgf-m) | 650° C. × 13 kgf/mm$^2$ Rupture time (hours) |
| Inventive | 1 | 65.2 | 80.2 | 22.3 | 65.4 | 8.4 | 1504 |
| materials (1) | 2 | 68.3 | 82.1 | 23.4 | 64.8 | 9.1 | 1412 |
| inventive | 22 | 64.7 | 80.0 | 21.4 | 64.5 | 8.9 | 1816 |
| materials (2) | 23 | 66.3 | 82.1 | 23.5 | 67.8 | 10.4 | 1421 |
| Inventive | 34 | 66.3 | 81.5 | 22.8 | 66.3 | 9.9 | 1288 |
| materials (3) | 35 | 65.2 | 80.8 | 21.4 | 65.2 | 9.0 | 1604 |
| Inventive | 41 | 64.3 | 80.8 | 21.5 | 65.8 | 8.1 | 2016 |
| materials (4) | 42 | 64.5 | 81.0 | 22.3 | 64.5 | 8.7 | 1937 |
| Inventive | 61 | 64.2 | 79.4 | 20.1 | 64.1 | 8.3 | 1698 |
| materials (6) | 62 | 65.3 | 81.2 | 21.1 | 63.2 | 8.5 | 1635 |
| | 63 | 65.2 | 81.3 | 22.3 | 64.4 | 8.5 | 2111 |
| | 64 | 65.5 | 81.5 | 21.8 | 63.7 | 9.2 | 1655 |
| | 65 | 66.2 | 82.7 | 21.4 | 64.0 | 9.3 | 1501 |
| | 66 | 65.8 | 81.6 | 20.9 | 63.7 | 8.3 | 1814 |
| | 67 | 64.9 | 81.4 | 21.3 | 64.8 | 7.8 | 2237 |
| | 68 | 65.5 | 81.3 | 21.8 | 64.3 | 8.4 | 2182 |
| | 69 | 65.3 | 81.3 | 23.5 | 64.8 | 8.8 | 1927 |
| | 70 | 64.2 | 80.8 | 22.8 | 65.7 | 8.2 | 2049 |

TABLE 14

| Material No. | | C | Si | Mn | Cr | Ni | V | Nb | Ta | Mo | W | Co | N | B | Nb | Hf |
|---|---|---|---|---|---|---|---|---|---|---|---|---|---|---|---|---|
| Inventive | 1 | 0.12 | 0.15 | 0.25 | 9.1 | 0.11 | 0.15 | 0.05 | — | 0.10 | 2.2 | 2.9 | 0.050 | — | — | — |
| materials (1) | 2 | 0.14 | 0.25 | 0.55 | 9.5 | 0.04 | 0.12 | 0.05 | 0.13 | 0.65 | 1.5 | 3.1 | 0.032 | — | — | — |
| Inventive | 22 | 0.14 | 0.23 | 0.08 | 9.4 | 0.05 | 0.12 | 0.05 | 0.10 | 0.63 | 1.5 | 3.3 | 0.033 | — | — | — |
| materials (2) | 23 | 0.11 | 0.05 | 0.09 | 8.1 | 0.18 | 0.13 | 0.01 | 0.04 | 0.29 | 1.0 | 0.2 | 0.067 | — | — | — |
| Inventive | 34 | 0.11 | 0.09 | 0.84 | 9.0 | 0.16 | 0.15 | — | 0.11 | 0.16 | 1.6 | 1.4 | 0.028 | 0.008 | — | — |
| materials (3) | 35 | 0.09 | 0.13 | 0.33 | 9.6 | 0.18 | 0.14 | 0.01 | 0.04 | 0.14 | 2.4 | 4.6 | 0.014 | 0.003 | — | — |
| Inventive | 41 | 0.12 | 0.14 | 0.05 | 9.1 | 0.11 | 0.15 | 0.05 | — | 0.10 | 2.0 | 2.9 | 0.008 | 0.006 | — | — |
| materials (4) | 42 | 0.15 | 0.24 | 0.07 | 9.5 | 0.04 | 0.12 | 0.04 | 0.12 | 0.65 | 1.4 | 3.2 | 0.005 | 0.005 | — | — |
| Inventive | 71 | 0.11 | 0.15 | 0.26 | 9.1 | 0.11 | 0.14 | 0.04 | — | 0.10 | 2.1 | 2.9 | 0.053 | — | 0.151 | 0.008 |
| materials (7) | 72 | 0.13 | 0.22 | 0.55 | 9.5 | 0.05 | 0.12 | 0.05 | 0.12 | 0.63 | 1.5 | 3.2 | 0.031 | — | 0.005 | 0.152 |
| | 73 | 0.14 | 0.23 | 0.07 | 9.4 | 0.04 | 0.13 | 0.04 | 0.11 | 0.64 | 1.4 | 3.1 | 0.033 | — | 0.093 | 0.062 |
| | 74 | 0.12 | 0.05 | 0.09 | 8.1 | 0.19 | 0.13 | 0.01 | 0.04 | 0.29 | 1.1 | 0.3 | 0.065 | — | 0.182 | 0.096 |
| | 75 | 0.11 | 0.09 | 0.87 | 9.1 | 0.15 | 0.15 | — | 0.12 | 0.15 | 1.6 | 1.4 | 0.029 | 0.007 | 0.006 | 0.112 |
| | 76 | 0.08 | 0.14 | 0.35 | 9.5 | 0.18 | 0.14 | 0.02 | 0.04 | 0.15 | 2.3 | 4.5 | 0.015 | 0.003 | 0.006 | 0.008 |
| | 77 | 0.12 | 0.13 | 0.05 | 9.1 | 0.12 | 0.14 | 0.06 | — | 0.11 | 1.9 | 3.0 | 0.008 | 0.005 | 0.045 | 0.012 |
| | 78 | 0.15 | 0.24 | 0.09 | 9.4 | 0.05 | 0.12 | 0.04 | 0.10 | 0.63 | 1.3 | 3.2 | 0.006 | 0.005 | 0.027 | 0.038 |
| | 79 | 0.14 | 0.21 | 0.07 | 9.3 | 0.86 | 0.13 | 0.04 | 0.10 | 0.65 | 1.6 | 3.4 | 0.034 | — | 0.098 | 0.105 |
| | 80 | 0.12 | 0.13 | 0.05 | 9.1 | 1.42 | 0.15 | 0.05 | — | 0.12 | 2.0 | 3.0 | 0.008 | 0.008 | 0.124 | 0.103 |

TABLE 15

| Material No. | | Room-temperature tension test: 0.2% yield strength (kgf/mm$^2$) | Tensile strength (kgf/mm$^2$) | Elongation (%) | Reduction in area (%) | 2 mm V-notched impact test: Impact value (20° C.) (kgf-m) | Creep rupture test Test conditions: 650° C. × 18 kgf/mm$^2$ (hours) |
|---|---|---|---|---|---|---|---|
| Inventive materials (1) | 1 | 65.2 | 80.2 | 22.3 | 65.4 | 8.4 | 1504 |
| | 2 | 66.3 | 82.1 | 23.4 | 64.8 | 9.1 | 1412 |
| Inventive materials (2) | 22 | 64.7 | 80.0 | 21.4 | 64.5 | 8.9 | 1816 |
| | 23 | 66.3 | 82.1 | 23.5 | 67.8 | 10.4 | 1421 |
| Inventive materials (3) | 34 | 66.3 | 81.5 | 22.8 | 66.3 | 9.9 | 1288 |
| | 35 | 65.2 | 80.8 | 21.4 | 65.2 | 9.0 | 1604 |
| Inventive materials (4) | 41 | 64.3 | 80.8 | 21.5 | 65.8 | 8.1 | 2016 |
| | 42 | 64.5 | 81.0 | 22.3 | 64.5 | 8.7 | 1937 |
| Inventive materials (7) | 71 | 65.8 | 80.8 | 20.1 | 63.2 | 7.3 | 2322 |
| | 72 | 66.7 | 82.1 | 20.4 | 62.8 | 8.5 | 2038 |
| | 73 | 64.3 | 79.6 | 19.8 | 61.4 | 8.2 | 2491 |
| | 74 | 65.2 | 80.6 | 20.6 | 62.4 | 7.5 | 2274 |
| | 75 | 65.4 | 81.0 | 21.4 | 62.8 | 9.2 | 1729 |
| | 76 | 65.8 | 81.2 | 20.7 | 61.6 | 8.9 | 1837 |
| | 77 | 64.1 | 79.6 | 20.4 | 60.8 | 7.9 | 2411 |
| | 78 | 66.8 | 82.3 | 19.8 | 60.5 | 8.5 | 2333 |
| | 79 | 65.7 | 82.1 | 22.4 | 65.3 | 9.5 | 2215 |
| | 80 | 66.2 | 82.5 | 23.6 | 64.7 | 9.0 | 2021 |

TABLE 16

| | Material No. | C | Si | Mn | Ni | Co | Cr | Mo | W | V | Nb | Ta | N | Index A |
|---|---|---|---|---|---|---|---|---|---|---|---|---|---|---|
| Inventive materials (1) | 1 | 0.12 | 0.15 | 0.25 | 0.11 | 2.9 | 9.1 | 0.10 | 2.20 | 0.15 | 0.05 | 0.00 | 0.05 | 5.86 |
| | 2 | 0.14 | 0.25 | 0.55 | 0.04 | 3.1 | 9.5 | 0.65 | 1.50 | 0.12 | 0.05 | 0.13 | 0.032 | 5.98 |
| | 3 | 0.11 | 0.06 | 0.95 | 0.15 | 0.2 | 8.1 | 0.35 | 1.20 | 0.13 | 0.01 | 0.05 | 0.067 | 5.76 |
| | 4 | 0.10 | 0.10 | 0.85 | 0.15 | 1.3 | 9.1 | 0.16 | 1.80 | 0.16 | 0 | 0.12 | 0.068 | 6.86 |
| | 5 | 0.08 | 0.14 | 0.33 | 0.18 | 4.6 | 9.6 | 0.15 | 2.40 | 0.14 | 0.02 | 0.04 | 0.051 | 4.67 |
| Comparative materials | 6 | 0.11 | 0.61 | 0.40 | 0.82 | 1.5 | 9.0 | 0.40 | 1.80 | 0.15 | 0 | 0.00 | 0.052 | 8.27 |
| | 7 | 0.16 | 0.25 | 1.21 | 0.10 | 0.0 | 10.2 | 0.41 | 1.70 | 0.14 | 0.05 | 0.00 | 0.032 | 10.05 |
| | 8 | 0.18 | 0.10 | 0.45 | 0.25 | 1.5 | 9.6 | 0.31 | 1.80 | 0.16 | 0 | 0.00 | 0.105 | 3.35 |
| | 9 | 0.12 | 0.15 | 0.43 | 0.10 | 2.0 | 9.1 | 0.30 | 1.70 | 0.25 | 0.05 | 0.00 | 0.084 | 6.72 |
| | 10 | 0.14 | 0.10 | 1.11 | 0.25 | 2.1 | 9.3 | 0.05 | 2.40 | 0.05 | 0 | 0.05 | 0.051 | 3.43 |
| | 11 | 0.08 | 0.45 | 0.54 | 0.65 | 2.5 | 10.8 | 0.31 | 2.30 | 0.15 | 0.05 | 0.20 | 0.053 | 10.57 |
| | 12 | 0.20 | 0.22 | 0.55 | 0.12 | 3.5 | 8.5 | 0.50 | 0.50 | 0.35 | 0 | 0.06 | 0.035 | −0.31 |
| | 13 | 0.10 | 0.42 | 0.63 | 0.15 | 5.5 | 9.2 | 0.30 | 2.30 | 0.16 | 0.05 | 0.05 | 0.032 | 4.14 |
| | 14 | 0.12 | 0.20 | 0.62 | 0.16 | 4.5 | 9.3 | 1.21 | 0.50 | 0.16 | 0 | 0.00 | 0.061 | 1.09 |
| | 15 | 0.06 | 0.15 | 0.80 | 0.35 | 4.1 | 7.5 | 0.62 | 2.20 | 0.05 | 0.05 | 0.05 | 0.06 | 3.01 |
| | 16 | 0.13 | 0.35 | 1.16 | 0.18 | 3.4 | 9.2 | 0.58 | 3.00 | 0.18 | 0.15 | 0.12 | 0.072 | 8.45 |
| | 17 | 0.25 | 0.10 | 0.80 | 0.18 | 5.0 | 11.1 | 0.55 | 0.80 | 0.17 | 0.02 | 0.08 | 0.061 | −5.68 |
| | 18 | 0.05 | 0.12 | 1.53 | 0.46 | 5.5 | 7.2 | 0.25 | 2.40 | 0.04 | 0.02 | 0.08 | 0.063 | −2.93 |

TABLE 17

| | Material No. | C | Si | Mn | Ni | Co | Cr | Mo | W | V | Nb | Ta | N | Index A |
|---|---|---|---|---|---|---|---|---|---|---|---|---|---|---|
| Inventive materials (2) | 21 | 0.12 | 0.15 | 0.05 | 0.11 | 2.9 | 9.1 | 0.10 | 2.20 | 0.15 | 0.05 | 0.00 | 0.05 | 6.26 |
| | 22 | 0.14 | 0.25 | 0.07 | 0.04 | 3.1 | 9.5 | 0.65 | 1.50 | 0.12 | 0.05 | 0.13 | 0.032 | 6.94 |
| | 23 | 0.11 | 0.05 | 0.09 | 0.18 | 0.2 | 8.1 | 0.29 | 1.10 | 0.13 | 0.01 | 0.04 | 0.067 | 6.67 |
| | 24 | 0.12 | 0.07 | 0.09 | 0.18 | 1.3 | 8.9 | 0.16 | 1.80 | 0.16 | 0 | 0.11 | 0.068 | 7.06 |
| | 25 | 0.08 | 0.14 | 0.06 | 0.18 | 4.6 | 9.6 | 0.15 | 2.40 | 0.14 | 0.02 | 0.04 | 0.051 | 5.21 |
| Inventive materials (3) | 31 | 0.12 | 0.15 | 0.25 | 0.11 | 2.9 | 9.1 | 0.10 | 2.10 | 0.15 | 0.05 | 0.00 | 0.009 | 6.79 |
| | 32 | 0.14 | 0.25 | 0.55 | 0.04 | 3.1 | 9.5 | 0.65 | 1.40 | 0.12 | 0.05 | 0.13 | 0.005 | 6.49 |
| | 33 | 0.11 | 0.06 | 0.95 | 0.15 | 0.2 | 8.1 | 0.35 | 1.10 | 0.13 | 0.01 | 0.05 | 0.024 | 6.75 |
| | 34 | 0.11 | 0.10 | 0.85 | 0.15 | 1.3 | 9.1 | 0.16 | 1.60 | 0.16 | 0 | 0.12 | 0.028 | 7.06 |
| | 35 | 0.08 | 0.14 | 0.33 | 0.18 | 4.6 | 9.6 | 0.15 | 2.40 | 0.14 | 0.02 | 0.04 | 0.014 | 5.78 |
| Inventive materials (4) | 41 | 0.12 | 0.14 | 0.05 | 0.11 | 2.9 | 9.1 | 0.10 | 2.00 | 0.15 | 0.05 | 0.00 | 0.008 | 6.86 |
| | 42 | 0.15 | 0.24 | 0.07 | 0.04 | 3.2 | 9.5 | 0.65 | 1.40 | 0.12 | 0.04 | 0.12 | 0.005 | 6.71 |
| | 43 | 0.12 | 0.05 | 0.09 | 0.18 | 0.3 | 8.1 | 0.29 | 0.90 | 0.12 | 0.01 | 0.04 | 0.025 | 6.68 |
| | 44 | 0.13 | 0.06 | 0.09 | 0.19 | 1.6 | 8.9 | 0.16 | 1.60 | 0.16 | 0 | 0.11 | 0.029 | 6.53 |
| | 45 | 0.08 | 0.14 | 0.04 | 0.17 | 4.6 | 9.5 | 0.15 | 2.40 | 0.14 | 0.02 | 0.04 | 0.015 | 6.27 |

TABLE 18

| | Material No. | C | Si | Mn | Ni | Co | Cr | Mo | W | V | Nb | Ta | N | Index A |
|---|---|---|---|---|---|---|---|---|---|---|---|---|---|---|
| Inventive materials (5) | 51 | 0.11 | 0.15 | 0.25 | 0.12 | 2.9 | 9.1 | 0.10 | 2.10 | 0.14 | 0.05 | 0.00 | 0.052 | 5.75 |
| | 52 | 0.13 | 0.24 | 0.55 | 0.04 | 3.1 | 9.4 | 0.64 | 1.60 | 0.12 | 0.05 | 0.13 | 0.033 | 6.45 |
| | 53 | 0.14 | 0.25 | 0.07 | 0.04 | 3.1 | 9.5 | 0.63 | 1.5O | 0.13 | 0.04 | 0.13 | 0.031 | 6.95 |
| | 54 | 0.11 | 0.05 | 0.09 | 9.18 | 0.3 | 8.2 | 0.30 | 1.10 | 0.14 | 0.01 | 0.04 | 0.068 | 6.75 |
| | 55 | 0.12 | 0.10 | 0.85 | 0.15 | 1.3 | 9.0 | 0.16 | 1.50 | 0.15 | 0 | 0.12 | 0.027 | 6.18 |
| | 56 | 0.08 | 0.16 | 0.33 | 0.19 | 4.6 | 9.6 | 0.14 | 2.30 | 0.14 | 0.02 | 0.04 | 0.013 | 5.55 |
| | 57 | 0.12 | 0.14 | 0.06 | 0.11 | 3.0 | 9.1 | 0.11 | 2.10 | 0.14 | 0.05 | 0.00 | 0.009 | 6.84 |
| | 58 | 0.14 | 0.24 | 0.07 | 0.04 | 3.3 | 9.3 | 0.65 | 1.40 | 0.13 | 0.04 | 0.12 | 0.006 | 6.79 |
| Inventive materials (6) | 61 | 0.12 | 0.14 | 0.26 | 0.12 | 3.0 | 9.2 | 0.11 | 2.20 | 0.14 | 0.04 | 0.00 | 0.051 | 5.49 |
| | 62 | 0.13 | 0.24 | 0.54 | 0.05 | 3.2 | 9.5 | 0.64 | 1.40 | 0.13 | 0.04 | 0.12 | 0.033 | 5.76 |
| | 63 | 0.14 | 0.23 | 0.08 | 0.05 | 3.3 | 9.3 | 0.63 | 1.50 | 0.12 | 0.05 | 0.09 | 0.035 | 5.89 |
| | 64 | 0.11 | 0.05 | 0.09 | 0.17 | 0.3 | 8.1 | 0.30 | 1.10 | 0.13 | 0.01 | 9.05 | 0.067 | 6.64 |
| | 65 | 0.12 | 0.12 | 0.83 | 0.16 | 1.5 | 9.1 | 0.15 | 1.50 | 0.14 | 0 | 0.10 | 0.027 | 5.80 |
| | 66 | 0.08 | 0.15 | 0.32 | 0.18 | 4.6 | 9.5 | 0.14 | 2.40 | 0.14 | 0.01 | 0.04 | 0.015 | 5.64 |
| | 67 | 0.12 | 0.14 | 0.05 | 0.12 | 3.0 | 9.1 | 0.11 | 2.00 | 0.14 | 0.06 | 0.00 | 0.008 | 6.60 |
| | 68 | 0.14 | 0.17 | 0.08 | 0.05 | 3.2 | 9.4 | 0.65 | 1.50 | 0.13 | 0.05 | 0.10 | 0.006 | 6.91 |

TABLE 19

| | Material No. | C | Si | Mn | Ni | Co | Cr | Mo | W | V | Nb | Ta | N | Index A |
|---|---|---|---|---|---|---|---|---|---|---|---|---|---|---|
| Inventive materials (7) | 71 | 0.11 | 0.15 | 0.26 | 0.11 | 2.9 | 9.1 | 0.10 | 2.10 | 0.14 | 0.04 | 0.00 | 0.053 | 5.69 |
| | 72 | 0.13 | 0.22 | 0.55 | 0.05 | 3.2 | 9.5 | 0.63 | 1.50 | 0.12 | 0.05 | 0.12 | 0.031 | 5.88 |
| | 73 | 0.14 | 0.23 | 0.07 | 0.04 | 3.1 | 9.4 | 0.64 | 1.40 | 0.13 | 0.04 | 0.11 | 0.033 | 6.35 |
| | 74 | 0.12 | 0.05 | 0.09 | 0.19 | 0.3 | 8.1 | 0.29 | 1.10 | 0.13 | 0.01 | 0.04 | 0.065 | 6.15 |
| | 75 | 0.11 | 0.09 | 0.87 | 0.15 | 1.4 | 9.1 | 0.15 | 1.60 | 0.15 | 0 | 0.12 | 0.029 | 6.58 |
| | 76 | 0.08 | 0.14 | 0.35 | 0.18 | 4.5 | 9.5 | 0.15 | 2.30 | 0.14 | 0.02 | 0.04 | 0.015 | 5.51 |
| | 77 | 0.12 | 0.13 | 0.05 | 0.12 | 3.0 | 9.1 | 0.11 | 1.90 | 0.14 | 0.06 | 0.00 | 0.008 | 6.24 |
| | 78 | 0.15 | 0.24 | 0.09 | 0.05 | 3.2 | 9.4 | 0.63 | 1.30 | 0.12 | 0.04 | 0.10 | 0.006 | 6.07 |

We claim:

1. A heat-resistant cast steel consisting of: on a weight percentage basis, 0.07 to 0.15% carbon, 0.05 to 0.30% silicon, 0.1 to 1% manganese, 8 to 10% chromium, 0.01 to 1% nickel, 0.1 to 0.3% vanadium, a total of 0.01 to 0.2% niobium and tantalum, 0.1 to 0.7% molybdenum, 1 to 2.5% tungsten, 0.1 to 5% cobalt and 0.03 to 0.07% nitrogen; and at least one of 0.001 to 0.2% neodymium and 0.001 to 0.2% hafnium; and the balance being iron and incidental impurities.

2. A heat-resistant cast steel consisting of: on a weight percentage basis, 0.07 to 0.15% carbon, 0.05 to 0.30% silicon, 0.01 to 0.1% manganese, 8 to 10% chromium, 0.01 to 1% nickel, 0.1 to 0.3% vanadium, a total of 0.01 to 0.2% niobium and tantalum, 0.1 to 0.7% molybdenum, 1 to 2.5% tungsten, 0.1 to 5% cobalt, and 0.01 to 0.07% nitrogen; and at least one of 0.001 to 0.2% neodymium and 0.001 to 0.2% hafnium; and the balance being iron and incidental impurities.

3. A heat-resistant cast steel consisting of: on a weight percentage basis, 0.07 to 0.15% carbon, 0.05 to 0.30% silicon, 0.1 to 1% manganese, 8 to 10% chromium, 0.01 to 1% nickel, 0.1 to 0.3% vanadium, a total of 0.01 to 0.2% niobium and tantalum, 0.1 to 0.7% molybdenum, 1 to 2.5% tungsten, 0.1 to 5% cobalt, and 0.002 to 0.01% boron, and 0.001 to 0.03% nitrogen; and at least one of 0.001 to 0.2% neodymium and 0.001 to 0.2% hafnium; and the balance being iron and incidental impurities.

4. A heat-resistant cast steel consisting of: on a weight percentage basis, 0.07 to 0.15% carbon, 0.05 to 0.30% silicon, 0.01 to 0.1% manganese, 8 to 10% chromium, 0.01 to 1% nickel, 0.1 to 0.3% vanadium, a total of 0.01 to 0.2% niobium and tantalum, 0.1 to 0.7% molybdenum, 1 to 2.5% tungsten, 0.1 to 5% cobalt, and 0.002 to 0.010% boron, and 0.001 to 0.03% nitrogen; and at least one of 0.001 to 0.2% neodymium and 0.001 to 0.2% hafnium; and the balance being iron and incidental impurities.

5. The heat-resistant cast steel of claim 2, wherein said steel contains, on a weight percentage basis 0.001 to 0.2% hafnium.

6. The heat-resistant cast steel of claim 2, wherein said steel contains, on a weight percentage basis 0.001 to 0.2% neodymium.

7. The heat-resistant cast steel of claim 3, wherein said steel contains, on a weight percentage basis 0.001 to 0.2% hafnium.

8. The heat-resistant cast steel of claim 3, wherein said steel contains, on a weight percentage basis 0.001 to 0.2% neodymium.

9. The heat-resistant cast steel of claim 4, wherein said steel contains, on a weight percentage basis 0.001 to 0.2% hafnium.

10. The heat-resistant cast steel of claim 4, wherein said steel contains, on a weight percentage basis 0.001 to 0.2% neodymium.

11. A heat-resistant cast steel as claimed in claims 1–4, wherein the index A (%) defined by the following equation on a weight percentage basis is 8% or less;

$$\text{Index A (\%)} = (\text{Cr content})(\%) + 6(\text{Si content})(\%) + 4(\text{Mo content})(\%) + 3(\text{W content})(\%) + 11(\text{V content})(\%) + 5(\text{Nb content})(\%) - 40(\text{C content})(\%) - 2(\text{Mn content})(\%) - 4(\text{Ni content})(\%) - 2(\text{Co content})(\%) - 30(\text{N content})(\%).$$

* * * * *